United States Patent [19]

Abe

[11] Patent Number: 4,589,433

[45] Date of Patent: May 20, 1986

[54] COIN DISPENSING APPARATUS

[75] Inventor: Hiroshi Abe, Tokyo, Japan

[73] Assignee: Asahi Seiko Kabushiki Kaisha, Japan

[21] Appl. No.: 675,656

[22] Filed: Nov. 28, 1984

[30] Foreign Application Priority Data

| | | | |
|---|---|---|---|
| Dec. 7, 1983 | [JP] | Japan | 58-188107[U] |
| Dec. 7, 1983 | [JP] | Japan | 58-188106[U] |
| Dec. 7, 1983 | [JP] | Japan | 58-188105[U] |
| Feb. 13, 1984 | [JP] | Japan | 59-22825 |

[51] Int. Cl.[4] ..... G07D 9/00

[52] U.S. Cl. ..... 133/5 R; 221/203; 221/254

[58] Field of Search ..... 366/279, 317, 325; 133/2, 5 R, 1 R; 384/609, 610, 611, 620; 221/203, 254

[56] References Cited

U.S. PATENT DOCUMENTS

| | | | |
|---|---|---|---|
| 1,239,904 | 9/1917 | Gohlke | 384/609 |
| 2,990,975 | 7/1961 | Sereno | 221/203 |
| 3,942,544 | 3/1976 | Breitenstein . | |
| 4,437,478 | 3/1984 | Abe . | |

*Primary Examiner*—Joseph J. Rolla
*Assistant Examiner*—Edward S. Ammeen
*Attorney, Agent, or Firm*—Parkhurst & Oliff

[57] ABSTRACT

A hopper type coin dispensing apparatus has a hopper for holding a supply of coins and a rotary disc for delivering the coins from the hopper one at a time and in desired quantities. The apparatus is particularly suitable for large coins, has a high dispensing efficiency, and is simple in construction. The apparatus according to the present invention prevents the rotary disc from joggling and thus eliminates any interference between a delivery knife and the engaging portions on the rotary disc and/or the coins delivered into an upper delivery zone. The apparatus prevents the inlet of the delivery chute from being blocked by the coins pushed upwardly by the powerful agitating action of an agitator.

4 Claims, 11 Drawing Figures

COIN DISPENSING APPARATUS

BACKGROUND OF THE INVENTION

1. Field of the Invention

The present invention relates to an apparatus for dispensing coins or tokens and more particularly to a hopper type coin dispensing apparatus including a hopper for storing coins or tokens in bulk and a rotary disc for delivering the coins from the hopper one at a time and in desired quantities.

2. Description of the Prior Art

U.S. Pat. No. 3,942,544 and No. 4,437,478 are illustrative of the prior art. There are disclosed a coin dispensing apparatus comprising a hopper for holding a supply of coins, a rotary disc rotatably disposed in the hopper at an angle to the horizontal, the rotary disc having at the central portion a central disc of a diameter depending on a diameter of a coin to be dispensed and having at the peripheral portion a plurality of coin engaging projections spaced in the peripheral direction, a delivery knife having a point being tangential to the upper periphery of the central disc and a delivery chute adapted for receiving the coin from the rotary disc by the delivery knife. The central disc and the pins define coin receiving spaces on the rotary disc. These coin receiving spaces on the rotary disc pickup coins from the lower portion of the hopper and deliver them to the upper delivery zone one at a time to be passed into the delivery chute by the delivery knife when the rotary disc is rotated within the hopper. In such a hopper type coin dispensing apparatus, in order to improve the coin dispensing efficiency, it is necessary that all of the coin receiving spaces on the rotary disc effectively pickup the coins from the lower portion of the hopper by the assistance of an agitator which can agitate the coins within the hopper sufficiently.

Furthermore, in order to improve the coin dispensing efficiency, it is also necessary to prevent the rotary disc from joggling in the normal direction to the plane of rotation caused by the variation of partial load subjected to the lower portion of the rotary disc by the coins within the hopper since such joggling of the rotary disc results in an interference between the delivery knife positioned at the upper delivery zone and/or the delivery chute and the engaging projections on the rotary disc and/or the coins delivered into the upper delivery zone. It is also important to prevent the inlet of the delivery chute from blocking by coins which are pushed upwardly by the powerful agitating action of the agitator and progressively passed into the upper delivery zone along with the coin carried by the engaging projection on the rotary disc.

In view of the foregoing, various means have been arranged in the hopper type coin dispensing apparatus, as the result, the construction of the coin dispensing apparatus is complicated and parts of the apparatus are increased so that lot of labor is required for assembling and manufacturing thereof.

SUMMARY OF THE INVENTION

The object of the present invention is to provide a hopper type coin dispensing apparatus, in particular suitable for large coins having a high dispensing efficiency with simple construction and without difficulty in manufacturing.

Another object of the present invention is to provide a powerful agitating means for the coin dispensing apparatus.

Still another object of the present invention is to provide means for preventing the joggling in rotation of the rotary disc.

Another object of the present invention is to provide coin antidoubling means or wiper for preventing coins pushed upwardly by the agitating action from passing into the upper delivery zone along with the coin carried by the engaging extension on the rotary disc.

A further object of the present invention is to provide a delivery knife for preventing the inlet of the delivery chute from blocking by the coins.

Still another object of the present invention is to provide a delivery chute without interference with the engaging projections on the rotary disc.

A feature of the present invention is to provide a coin dispensing apparatus comprising a supporting plate inclined to the horizontal, a hopper connected to the supporting plate for holding a supply of coins, a rotary disc rotatably supported on the supporting plate within the hopper, the rotary disc having at the central portion a central disc of a diameter depending on a diameter of a coin to be dispensed and having at the peripheral portion a plurality of coin engaging projections spaced in the peripheral direction, bearing means including a plurality of balls interposed between the supporting plate and the outer peripheral portion of the rotary disc and spaced to each other in the peripheral direction for rotatably supporting the rotary disc on the supporting plate, a drive shaft extended through the supporting plate and the rotary disc for rotating said rotary disc, a delivery knife secured to the supporting plate with a point thereof being tangential to the upper periphery of the central disc, a delivery chute adapted for receiving the coins from the rotary disc by the delivery knife, antidoubling means for controlling the coin passing at the upper delivery zone and agitating means on the central disc for agitating coins within the hopper, the agitating means including a plurality of coil springs arranged so as to extend radially of the drive shaft on the central disc, an elastomer retainer for retaining the inner ends of the coil springs resiliently and connecting means being secured to the drive shaft for connecting the elastomer retainer in compressed state to the rotary disc and for urging resiliently the rotary disc towards the supporting plate.

DESCRIPTION OF THE DRAWINGS

Further objects and advantages of the invention will become apparent as the following description of an illustrative embodiment proceeds with reference to the drawings in which.

DESCRIPTION OF THE PREFERRED EMBODIMENTS

Figure 1:
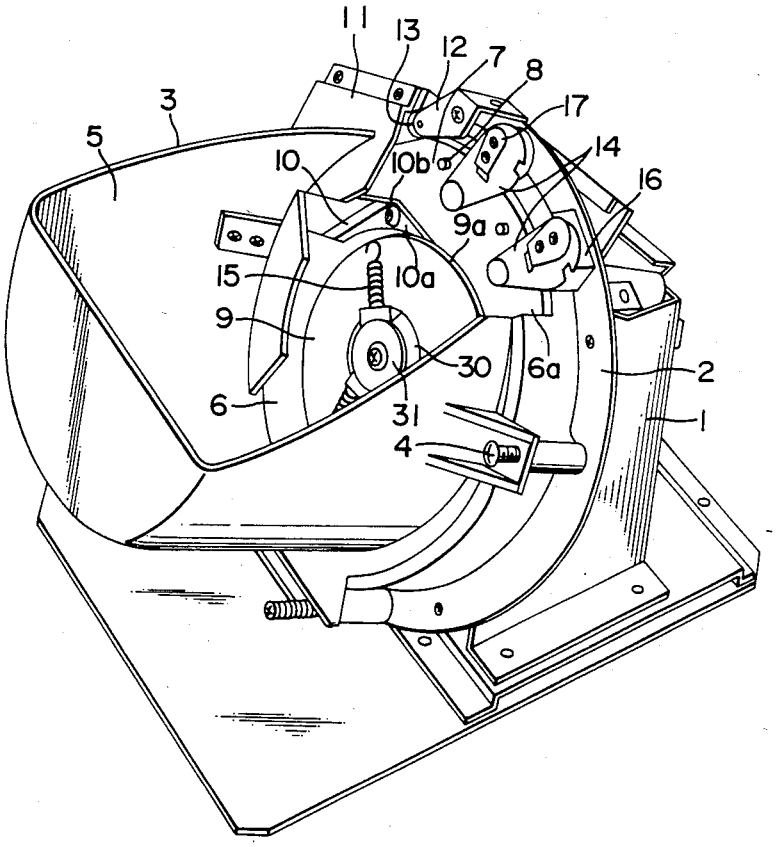
FIG. 1 is a perspective view of the illustrative coin dispensing apparatus according to the present invention.

With reference to drawings illustrating an embodiment according to the present invention, it will be seen that on a supporting stand 1, a rotary disc supporting plate 2 is fixedly mounted in a position inclined to the horizontal and a hopper head 3 is connected to the supporting plate 2 by means of bolts 4 to form a hopper 5 for holding a supply of coins.

Within the hopper 5, a rotary disc 6 is rotatably supported on the inclined supporting plate 2 and is provided at the peripheral portion 6*a* thereof with a plurality of coin engaging projections such as pins 8 extruded from the top surface of the rotary disc with a height corresponding to thickness of a coin to be dispensed and spaced in the peripheral direction with a distance corresponding to diameter of the coin. Concentrically overlaying the top surface of the rotary disc 2 is also provided with a central disc 9. Thus central disc 9 and the pins 8 on the rotary disc 2 define a plurality of coin receiving spaces on the rotary disc 2. These coin receiving spaces on the rotary disc 2 pickup coins from the lower portion of the hopper and deliver them to the upper delivery zone 7 one at each of the receiving spaces when the rotary disc is rotated within the hopper.

At the upper delivery zone 7, a delivery knife 10 is secured to the supporting plate and is extended across the peripheral portion 6*a* of the rotary disc 2 so that the top surface of the knife point 10*a* is tangential to the upper periphery 9*a* of the central disc 9 and thereby the coin carried by the pin 8 is transferred from the upper periphery 9*a* of the central disc 9 onto the delivery knife 10 at the upper delivery zone 7 to pass the coin into the discharge chute 11.

Figure 2:
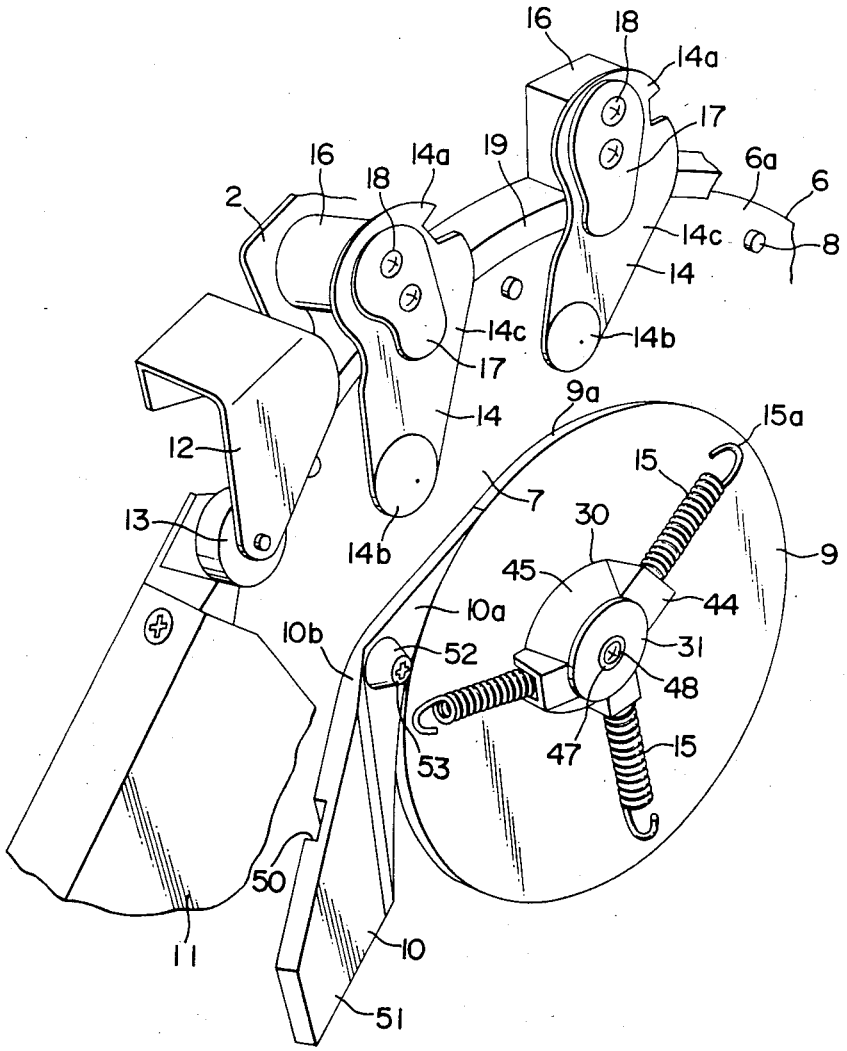
FIG. 2 is an enlarged partial perspective view of the coin dispensing apparatus shown in FIG. 1.

The delivery knife 10 is made of a flat metal plate as shown in FIG. 2 having a thin knife point portion 10*a* of a thickness corresponding to the thickness of the coin to be dispensed and a thick portion 51 formed with a channel 50 for passing of pin 8. The thin portion is provided with a frustoconical deflector 52 secured by means of a set screw 53 and the thick portion 51 has a coin discharging rail 10*b* which is inclined downwards within the discharge chute 11.

Opposite upwardly to the delivery knife 10 is provided with a counter roller 13 which is rotatably supported on the free end of a spring loaded rocker arm 12 of a coin mounting switch so that the switch is actuated by the coin passing between the delivery knife 10 and the counter roller 13.

At the upper delivery zone, there is at least one antidoubling means or wiper 14 for controlling the coin passing to the discharge chute 11 as shown in FIG. 2. The antidoubling wiper 14 is made of sheet shaped elastomer material and is secured to a mount piece 16 on the supporting plate 2 at the upper base portion 14*a* thereof together with a deflecting metal sheet 17 by means of screws 18 so that the wiper 14 is suspended from the mount piece 16 over an upper circumferential wall 19 which circles the rotary disc to overlay the free end portion 14*b* of the wiper 14 on the top surface of the peripheral portion 6*a*. The free end 14*b* is provided with a conical projection. The intermediate portion 14*c* of the wiper 14 is spaced from the top surface of the peripheral portion 6*a* to provide a clearance 20 for passing of the pin 8.

Figure 3:
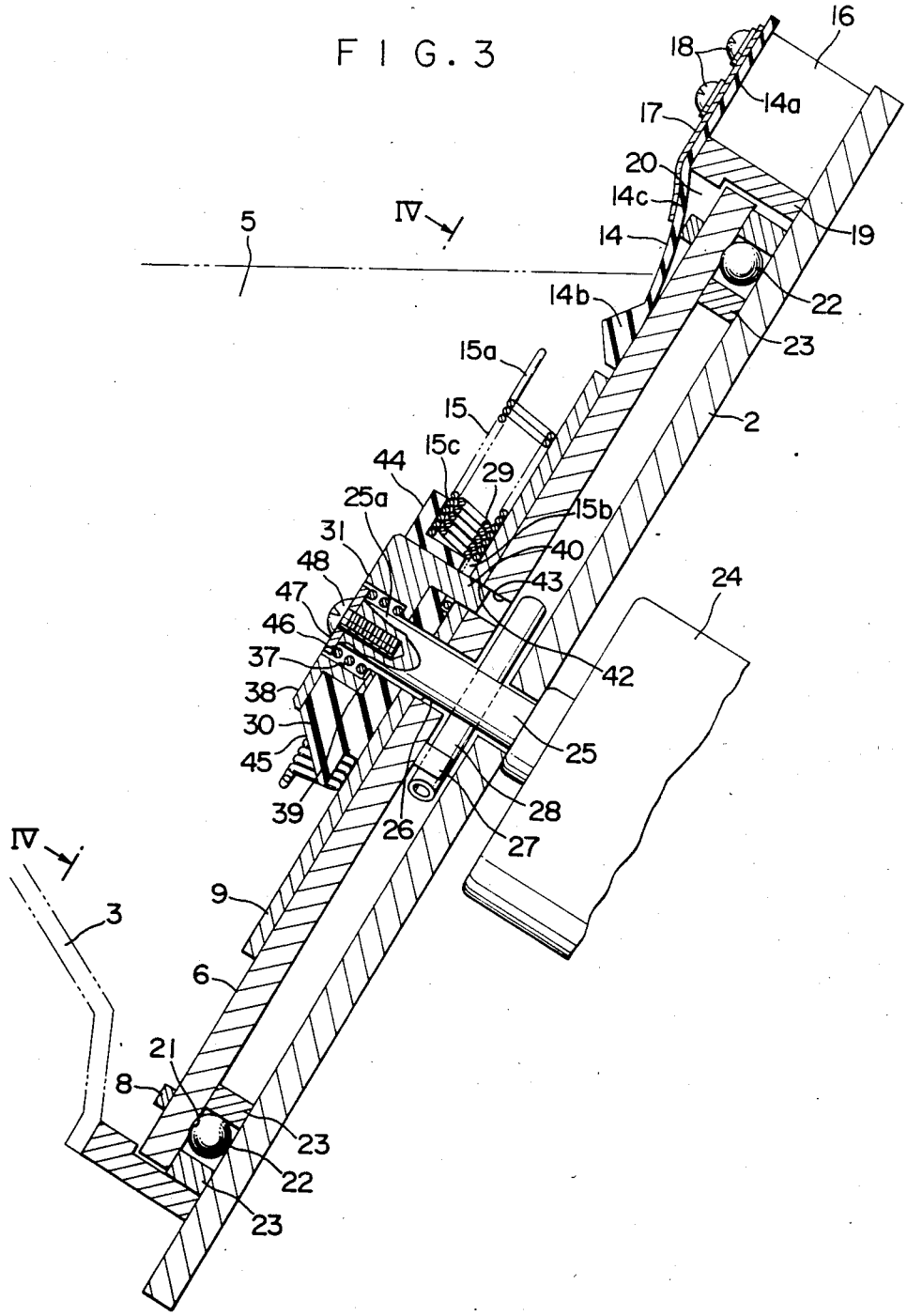
FIG. 3 is a sectional view through the center of the rotary disc.
Figure 4:
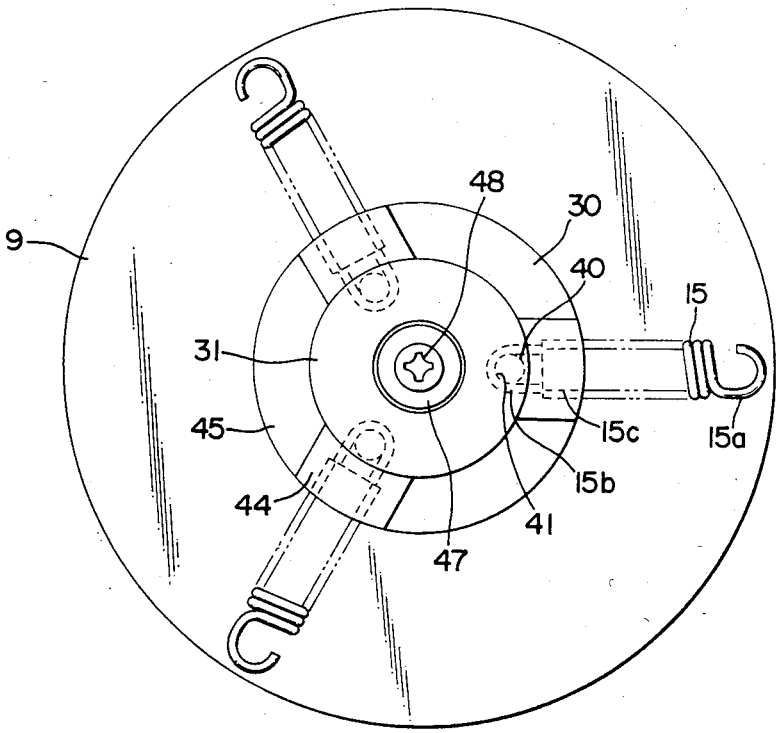
FIG. 4 is a front view of the agitating means on the central disc taken from line IV—IV of FIG. 3.

Referring to FIG. 3, the rotary disc 6 has a concentric circular race 21 formed at the peripheral portion on the bottom surface thereof and a plurality of balls 22 are rotatably confined in retainers 23, respectively, which are spaced in the peripheral direction and interposed between the top surface of the supporting plate 2 and the bottom surface of the rotary disc 6 for antifriction engaging the surface of the circular race 21 so that the rotary disc 6 is rotatably supported at the outer peripheral portion thereof on the supporting plate 2 by means of balls 22. The rotary disc 6 is resiliently urged at the center portion thereof towards the supporting plate 2 as will be mentioned below and as a result all of the outer peripheral portion of the rotary disc is pressed onto the balls 22 on the supporting plate so that the rotary disc is prevented from joggling in the normal direction to the plane of the rotary disc during rotation owing to the unbalanced load subjected to the lower portion of the rotary disc by the coin within the hopper.

The rotary disc 6 also has an eccentrically driven pin 27 extruded from the bottom surface thereof for engagement by a radially projecting drive pin 28 secured to the drive shaft 25. When the drive shaft 25 is driven and rotated through a reduction gear in the gear box 24 by means of motor, the rotary disc 6 is connected operatively to the drive shaft 25 by the drive pin 28 in its engagement with the driven pin 27 to rotate the rotary disc 6. The drive shaft is extended through the supporting plate 2, the rotary disc 6 and the central disc 9 on the rotary disc from the reduction gear box 24.

In the embodiment illustrated in the drawings, on the central disc 9, three agitating coil springs 15 are arranged so as to extend radially of the drive shaft 25. Each of these coil springs 15 has at the opposite ends hook portions 15*a* and 15*b*, respectively and has a reinforcing coil spring 29 of a short length and a smaller diameter or the like inserted within the inner end portion 15*c* of the coil spring 15 which is resiliently held as will be mentioned below. The coil spring 15 has preferable 10 mm diameter and is made of a wire of 1.5 mm diameter to provide a desired strenth and flexibility.

These coil springs 15 are resiliently held at the inner end portions 15*c* on the central disc 9 by an elastomer retainer 30 made of elastomer material and a connecting piece 31 which are mounted on the extended end portion 25*a* of the drive shaft 25.

Figure 5:
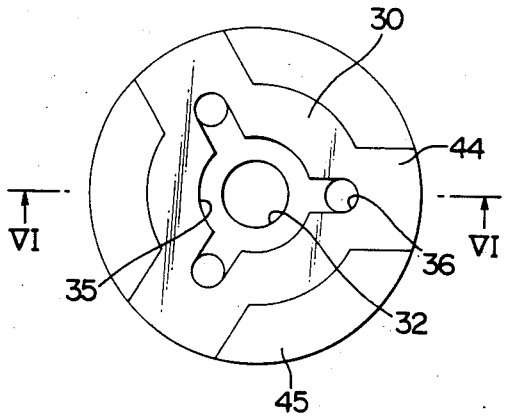
FIG. 5 is a plan view of the elastomer retainer of the agitating means.
Figure 6:
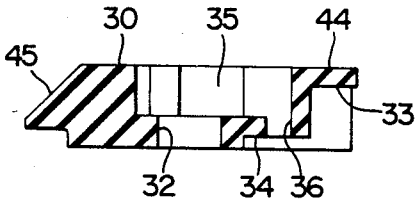
FIG. 6 is a sectional view of the elastomer retainer taken on line VI—VI in FIG. 5.

The elastomer retainer 30 has a central bore 32 for inserting the extended end portion 25*a*, recesses 33 formed radially for holding the inner end portions 15*c* of the coil springs 15, retaining recesses 34 partially extended from the recesses 33 for retaining the inner end hooks 15*b*, a recess 35 for mounting the connecting piece 31 and holes 36 for engaging with connecting legs 40 of the connecting piece 31 as illustrated in FIGS. 5 and 6, and the connecting piece 31 has a center bore 37 for inserting the extended end portion 25*a* of the drive shaft 25, retainer pressing upper portion 38, a spring seat 39 for a compression spring 46 and connecting legs 40 for engaging with the inner end hook 15*b* of the coil spring 15. The connecting legs 40 are extended through the holes 36 of the elastomer retainer 30, the inner holes 41 of the hooks 15*b* of the coil springs 15, holes 42 formed in the central disc 9 and holes 43 formed in the rotary disc 6 so as to connect the elastomer retainer 30, the coil springs 15, the central disc 9 and the rotary disc 6 integrally. The elastomer retainer also has a conical portion 45.

The coil springs 15, the elastomer retainer 30 and the connecting piece 31 are assembled on the central disc 9 and the connecting piece 31 is retained through a spring 46 interposed between the spring seat 39 and a washer 47 by a screw 48 secured to the end of the drive shaft 25. Thus the connecting piece 31, the elastomer retainer 30, the inner end portions **15*c* of the coil springs, central disc 9 and the rotary disc 6 are connected and also the rotary disc 6 is urged towards the supporting plate 2 so as to keep the outer peripheral portion of the rotary disc 6 in pressedly contact with the balls 22 on the supporting plate 2**.

Figure 9:
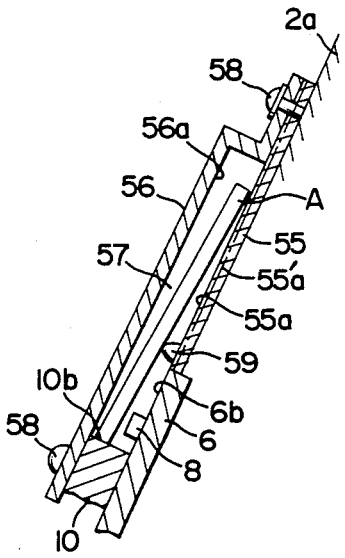
FIG. 9 is a sectional view of the delivery chute.
Figure 7A:
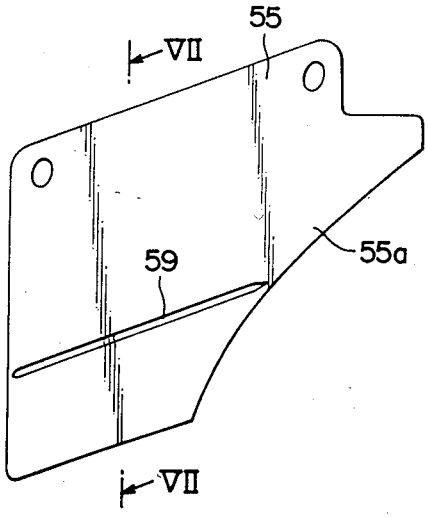
FIGS. 7(*a*) and 7(*b*) are front views of one of side plates of the delivery chute and a sectional view taken on line VII—VII in FIG. 7(*a*)
Figure 7B:
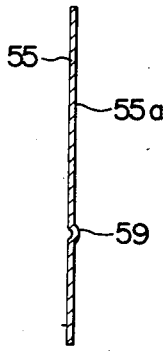
Figure 8A:
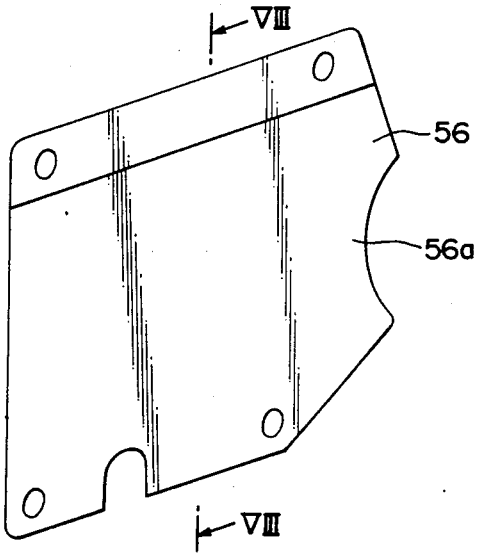
FIGS. 8(*a*) and 8(*b*) are front views of other side plates of the delivery chute and a sectional view taken on line VII—VII in FIG. 8(*a*)
Figure 8B:
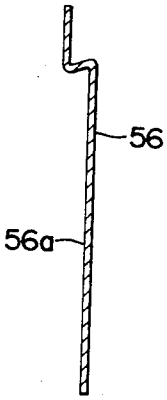

Referring to FIGS. 7–9. The delivery chute 11 is consisted of a coin guide side plate 55 as ilustrated in FIG. 7 and a covering side plate 56 as illustrated in FIG. 8, these two side plates 55 and 56 are spaced to each other to define a coin passage 57 between the opposite inner surfaces **55*a* and 56*a* as shown in FIG. 9. The coin guide side plate 55 is secured to the supporting plate 2 together with the covering side plate 56 by means of screws 58 so that the inner surface 55*a* of the coin guide side plate 55 is on a level with the surface 6*b* of the peripheral portion 6*a* of the rotary disc 6 or on a lower level as shown by an imaginary line 55*a*'. The side plate surface 55*a* has a guide ridge 59 extruded from the surface higher than the pin 8 on the rotary disc 6. The guide ridge 59 extends in a coin discharge direction, i.e. in parallel with the top edge 10*b* of the delivery knife thick portion 51 inclined downwards so as to contact with the side face of a coin A as shown in FIG. 9**.

What is claimed is:

1. A coin dispensing apparatus, comprising:

a supporting plate inclined to the horizontal, a hopper mounted on the supporting plate for holding a supply of coins, a rotary disc rotatably supported on the supporting plate within the hopper, the rotary disc having at the central portion thereof a central disc of a diameter depending on a diameter of a coin to be dispensed and having at the peripheral portion a plurality of coin engaging projections spaced in the peripheral direction;

bearing means including a plurality of balls interposed between the supporting plate and the outer peripheral portion of the rotary disc and spaced apart from each other in the peripheral direction for rotatably supporting the rotary disc on the supporting plate, a drive shaft extending through the supporting plate and the rotary disc for rotating said rotary disc, a delivery knife secured to the supporting plate with a knife point thereof being tangential to the upper periphery of the central disc, a delivery chute adapted for receiving the coins from the rotary disc by the delivery knife;

antidoubling means for controlling passing of the coins at the upper delivery zone;

agitating means on the central disc for agitating coins within the hopper, the agitating means including a plurality of coil springs arranged so as to extend radially of the drive shaft on the central disc, an elastomer retainer for resiliently retaining the inner end portions of the coil springs; and connecting means secured to the drive shaft for connecting the elastomer retainer in a compressed state to the rotary disc and for urging resiliently the rotary disc towards the supporting plate, said connecting means having a plurality of connecting legs spaced in the circumferential direction, wherein said elastomer retainer, said coil springs, said central disc are integrally connected to said rotary disc with said connecting legs.

2. A coin dispensing apparatus, comprising:

a supporting plate inclined to the horizontal, a hopper mounted on the supporting plate for holding a supply of coins, a rotary disc rotatably supported on the supporting plate within the hopper, the rotary disc having at the central portion thereof a central disc of a diameter depending on a diameter of a coin to be dispensed and having at the peripheral portion a plurality of coin engaging projections spaced in the peripheral direction;

bearing means including a plurality of balls interposed between the supporting plate and the outer peripheral portion of the rotary disc and spaced apart from each other in the peripheral direction for rotatably supporting the rotary disc on the supporting plate, a drive shaft extending through the supporting plate and the rotary disc for rotating said rotary disc, a delivery knife secured to the supporting plate with a knife point thereof being tangential to the upper periphery of the central disc, a delivery chute adapted for receiving the coins from the rotary disc by the delivery knife;

antidoubling means for controlling passing of the coins at the upper delivery zone;

agitating means on the central disc for agitating coins within the hopper, the agitating means including a plurality of coil springs arranged so as to extend radially of the drive shaft on the central disc, said coil springs being resiliently held at the inner end portions on the central disc by an elastomer retainer made of elastomer material and having an inner end hook retained to the central disc, an elastomer retainer for resiliently retaining the inner end portions of the coil springs; and connecting means being secured to the drive shaft for connecting the elastomer retainer in a compressed state to the rotary disc and for urging resiliently the rotary disc towards the supporting plate.

3. A coin dispensing apparatus, comprising:

a supporting plate inclined to the horizontal, a hopper mounted on the supporting plate for holding a supply of coins, a rotary disc rotatably supported on the supporting plate within the hopper, the rotary disc having at the central portion thereof a central disc of a diameter depending on a diameter of a coin to be dispensed and having at the peripheral portion a plurality of coin engaging projections spaced in the peripheral direction;

bearing means including a plurality of balls interposed between the supporting plate and the outer peripheral portion of the rotary disc and spaced apart from each other in the peripheral direction for rotatably supporting the rotary disc on the supporting plate, a drive shaft extending through the supporting plate and the rotary disc for rotating said rotary disc, a delivery knife secured to the supporting plate with a knife point thereof being tangential to the upper periphery of the central disc, a delivery chute adapted for receiving the coins from the rotary disc by the delivery knife, said delivery chute comprising a coin guide side plate and a covering side plate spaced from the coin guide side plate which is secured to said supporting plate so as to position the inner surface thereof on a level with the surface of said peripheral portion of said rotary disc or on a lower level, the inner surface of the coin guide side plate having a guide ridge extruded from the surface higher than said coin engaging projection on said rotary disc and extending in a coin discharge direction;

antidoubling means for controlling passing of the coins at the upper delivery zone;

agitating means on the central disc for agitating coins within the hopper, the agitating means including a plurality of coil springs arranged so as to extend radially of the drive shaft on the central disc, an elastomer retainer for resiliently retaining the inner end portions of the coil springs; and connecting means being secured to the drive shaft for connecting the elastomer retainer in a compressed state to the rotary disc and for urging resiliently the rotary disc towards the supporting plate.

4. The apparatus of claim 3, wherein said rotary disc is urged resiliently at the center portion thereof towards said supporting plate through the elastomer retainer by a connecting means secured to said drive shaft keeping the outer peripheral portion of the rotary disc in close contact with said balls of the bearing means on the supporting plate.

* * * * *